US005806224A

United States Patent [19]

Hager

[11] Patent Number: 5,806,224

[45] Date of Patent: Sep. 15, 1998

[54] SEMI-AUTOMATIC FIREARM WITH NON-REMOVABLE MAGAZINE

[76] Inventor: Allan D. Hager, 8241 Los Robles Dr., Groveland, Fla. 34736

[21] Appl. No.: 904,961

[22] Filed: Aug. 1, 1997

Related U.S. Application Data

[60] Provisional application No. 60/023,262 Aug. 9, 1996.

[51] Int. Cl.[6] ..... F41A 9/61

[52] U.S. Cl. ..... 42/18; 42/50

[58] Field of Search ..... 42/6, 50, 18

[56] References Cited

U.S. PATENT DOCUMENTS

| | | | |
|---|---|---|---|
| 2,910,795 | 11/1959 | Aaren | 42/50 |
| 3,190,023 | 6/1965 | Reed | 42/18 |
| 4,484,404 | 11/1984 | Johnson | 42/90 |
| 4,676,137 | 6/1987 | Stockton et al. | 89/33.02 |
| 5,309,660 | 5/1994 | Blackamore | 42/50 |
| 5,367,810 | 11/1994 | Stead et al. | 42/17 |
| 5,450,683 | 9/1995 | Miller, IV | 42/50 |
| 5,452,534 | 9/1995 | Lambie | 42/18 |
| 5,461,811 | 10/1995 | Ciener | 42/50 |
| 5,495,687 | 3/1996 | Waiser | 42/50 |

*Primary Examiner*—Charles T. Jordan
*Assistant Examiner*—Meena Chelliah
*Attorney, Agent, or Firm*—Richard C. Littman

[57] ABSTRACT

An accessory which becomes an integral part of a semi-automatic firearm whereby a detachable box magazine is converted to no longer be immediately separable for exchange with another magazine. The firearm is preferably an AR-15 firearm which is modified by the accessory to pivotally mount the firearm's magazine to a non-removable shroud affixed to the firearm. The magazine shroud includes a retaining band which generally encircles the magazine, and provides a track to allow the magazine to be disengaged from the firearm and dropped sufficiently therefrom to be tilted to an open position for loading and unloading cartridges.

14 Claims, 3 Drawing Sheets

SEMI-AUTOMATIC FIREARM WITH NON-REMOVABLE MAGAZINE

CROSS-REFERENCE TO RELATED APPLICATION

This application claims the benefit of U.S. provisional patent application Ser. No. 60/023,262, filed Aug. 9, 1996.

BACKGROUND OF THE INVENTION

1. Field of the Invention

The invention relates generally to a semi-automatic firearm with a non-removable magazine. More specifically, the invention relates to a semi-automatic firearm which is modified by a magazine accessory to form a non-detachable connection between the firearm and its magazine to prevent reloading with a separate magazine, wherein the magazine includes pivotal mountings to permit loading and unloading of individual cartridges.

2. Description of Related Art

Semi-automatic firearms were introduced more than a century ago. The first semi-automatic rifle, a Mannlicher, was introduced in 1885. The M-16 automatic rifle and the AR-15 semi-automatic rifle have been the standard issue weapons of the U.S. military and civilian police departments for many years. This particular rifle design was originated by E. M. Stoner and developed by Fairchild Engine and Airplane Company in the 1950's. A civilian semi-automatic version of the M-16 designated as the AR-15 is sold to civilians by Olympic Arms of Olympia, Wash. When used herein, the phrase "semi-automatic firearm" is intended to include the AR-15s previously and currently being produced.

In September 1994 crime legislation commonly designated the "Crime Bill" was signed into law. The Crime Bill labels firearms as "assault weapons" by two methods: name and description. All told, the ban affects more than 175 semi-automatic rifles, pistols and shotguns and revolving cylinder shotguns - a cross section of firearms of various sizes, shapes, and calibers/gauges. The Crime Bill recites broadly that any semi-automatic rifle or handgun is banned which includes a detachable magazine plus a number of other factors which are not relevant to the instant invention. The instant invention addresses only the feature of "non-detachability" of the magazine of the weapon.

Weapons described by the related art have magazines which are readily detachable, as exemplified by the following patents. U.S. Pat. No. 4,676,137, issued on Jan. 30, 1987 to Warren D. Stockton et al., describes a magazine which is releasably mounted atop the firearm. U.S. Pat. No. 5,309,660, issued on May 10, 1994 to James D. Blackamore, describes a magazine which is inserted so that the topmost bullet in the magazine is in firing position. U.S. Pat. No. 5,367,810, issued on Nov. 29, 1994 to Heyns W. Stead et al., describes a magazine that pivots in order to facilitate loading. A gate member is pivotally mounted at an open end of a tube and has a protuberance in the path of an end cartridge to inhibit ejection of the cartridge from the tube. The magazine is nevertheless detached from the firearm to permit replacement with a fresh magazine. U.S. Pat. No. 5,450,683, issued on Sep. 19, 1995 to John O. Miller, IV, describes a magazine construction for gas powered firearm wherein the expanding gasses from the breech are used to advance the bullets in the magazine. U.S. Pat. No. 5,461,811, issued on Oct. 31, 1995 to Jonathan A. Ciener, describes a conversion cartridge magazine for use in converting a gun to a smaller caliber. U.S. Pat. No. 5,495,687, issued on Mar. 5, 1996 to Shimon Waiser, describes a magazine having shorter magazine springs whereby the magazine has the capability to hold more cartridges with the same size of the magazine tube.

None of the above patents disclose a semi-automatic firearm having a permanent-type connection between the firearm and its magazine, wherein the magazine is pivotally mounted for loading and unloading cartridges, but non-removable from the firearm for the purpose of inserting a replacement magazine. None of the above inventions and patents, taken either singly or in combination, is seen to describe the instant invention as claimed.

SUMMARY OF THE INVENTION

The present invention is a semi-automatic firearm adapted with a non-removable magazine. More specifically, the invention relates to an accessory which becomes an integral part of a semi-automatic firearm whereby a detachable box magazine is converted to no longer be immediately separable for exchange with another magazine.

In particular, the firearm is preferably an AR-15 firearm which is modified by the accessory to pivotally mount the firearm's magazine to a non-removable shroud affixed to the firearm. The magazine shroud includes a retaining band which generally encircles the magazine, and provides a track to allow the magazine to be disengaged from the firearm and dropped sufficiently therefrom to be tilted to an open position for loading and unloading cartridges.

Accordingly, it is a principal object of the invention to provide a semi-automatic firearm having a non-detachable connection between the firearm and its magazine.

It is another object of the invention to provide a modified AR-15 firearm having a permanent connection between the firearm and its magazine.

It is another object of the invention to provide a semi-automatic firearm having a permanent connection between the firearm and its magazine, which firearm may be easily and efficiently manufactured and marketed.

It is a further object of the invention to provide an accessory which provides a permanent connection between the firearm and its magazine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
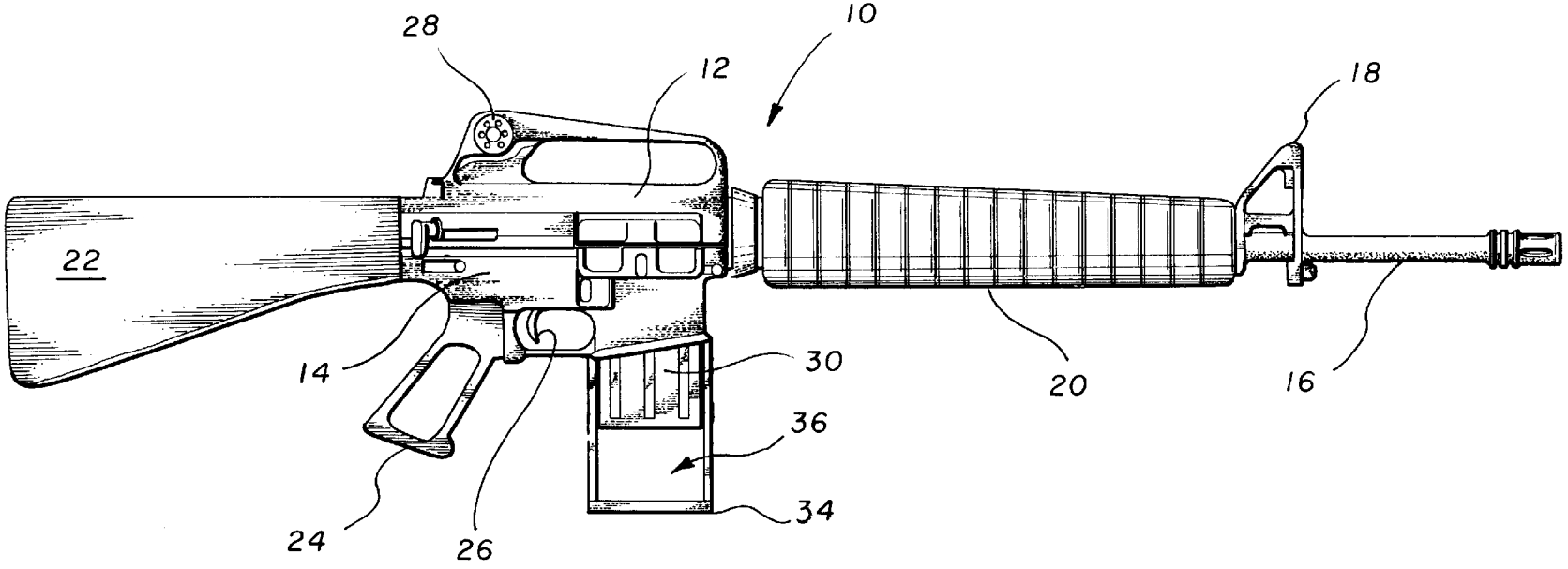
FIG. 1 is a side elevational view of a first embodiment of a firearm showing a magazine fully inserted into a shroud permanently affixed to the firearm in accordance with the present invention.

Referring to FIG. 1, a side view of a firearm 10, exemplified as an AR-15 type rifle, is shown as modified by the magazine 30 and a magazine shroud or enclosure 34 according to the present invention. Since the basic firearm is of a well-known type, only those parts of the firearm essential to an understanding of the invention will be described in detail. Broadly, the firearm 10 includes an upper receiver 12 attached to a lower receiver 14 and having a barrel 16 threadedly engaged in the upper receiver 12. A barrel 16 has a front sight 18, the barrel 16 enclosed by a handguard enclosure 20 between the front sight 18 and the upper receiver 12. The upper receiver 12 and the lower receiver 14 are both braced by a buttstock 22, which is threadedly attached to the lower receiver 14. A handgrip 24 is attached to the lower receiver 14 directly behind a trigger and hammer assembly 26. A rear sight assembly 28 is adjustably mounted on the upper receiver 12.

The instant invention, in essence, is an accessory modifying or converting the lower receiver 14 of a firearm and an otherwise detachable box magazine to be no longer separable from the firearm 10. The accessory includes the modified magazine 30 and a magazine enclosure 34, and may be provided independent of a firearm as an accessory for later affixation to a preexisting firearm.

The accessory of the instant invention broadly comprises a magazine shroud or enclosure 34 and a rectangular-shaped magazine 30 which is pivotally mounted within the magazine shroud 34, which in turn is immovably affixed to the lower receiver 14. More specifically, the kit includes a pivoting means and track associated with the magazine 30 and the shroud 34, whereby the magazine 30 may be translated from an inserted vertical position confined within both the shroud 34 and lower receiver 14 to a pivoted angular position wherein a top end 46 for loading cartridges into the magazine is canted to one side of the shroud 34 by operatively moving the magazine 30 while disengaged from the lower receiver 14 through a window-like opening 36 defined by a side of the shroud 34. For example, to load the magazine 30, the magazine 30 is disengaged from the lower receiver 14, slid downward within the shroud 34 to a lowermost and maximum position allowed by the shroud 24, and then rotated to either side of the shroud 34 so that only the magazine top section 64 is passed through the window-like opening 36 outside the enclosure 34.

Figure 4:
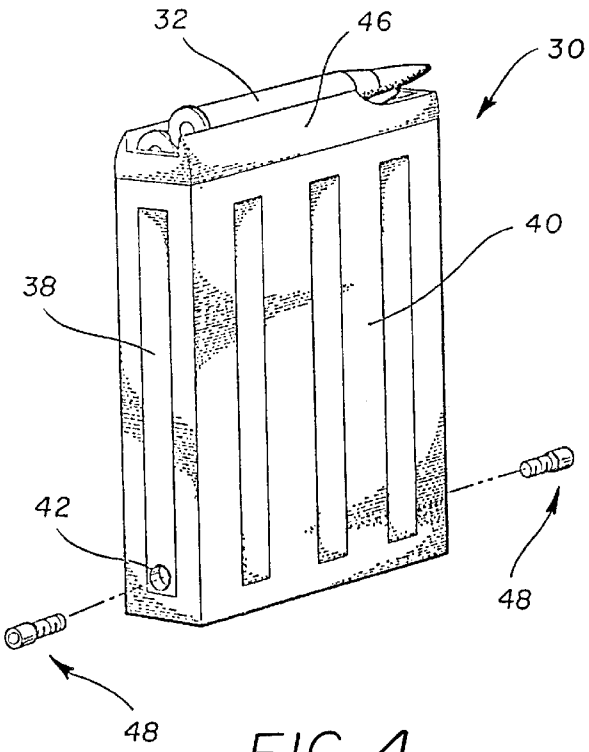
FIG. 4 is a perspective, environmental, exploded view of the magazine as shown in FIG. 2.

With reference to FIG. 4, a magazine is shown modified according to the present invention, but should be understood to have each of the operable features necessary for engaging its associated firearm and permitting automatic or semi-automatic chambering of cartridges. Thus, a rectangular-shaped box magazine 30 is provided, forming an interior well for receiving and releasing a plurality of cartridges 32, and having a top end 46 with a conventional mouth dimensioned and configured to permit loading of a plurality of cartridges 32 into the magazine well and for engaging the lower receiver 14 to permit semi-automatic chambering of a single cartridge into the barrel 16. The box-shape is defined by a first end wall 38 and an second end wall which is laterally opposed to the first end wall 40 (and hidden from view); a bottom wall (also hidden); a first side wall 40 and a second side wall (also hidden) which is laterally opposed to the first side wall 40.

The magazine 10 is further modified to include a pivot stud 48 on each side wall 38, depending outwardly from the side wall 38, and located near the bottom wall. A bore 42 for receiving pivot stud 48 may be provided in preexisting magazines and the pivot stud 48 may be a screw-type bolt or pin which is affixed into each of the bores 42.

Figure 2:
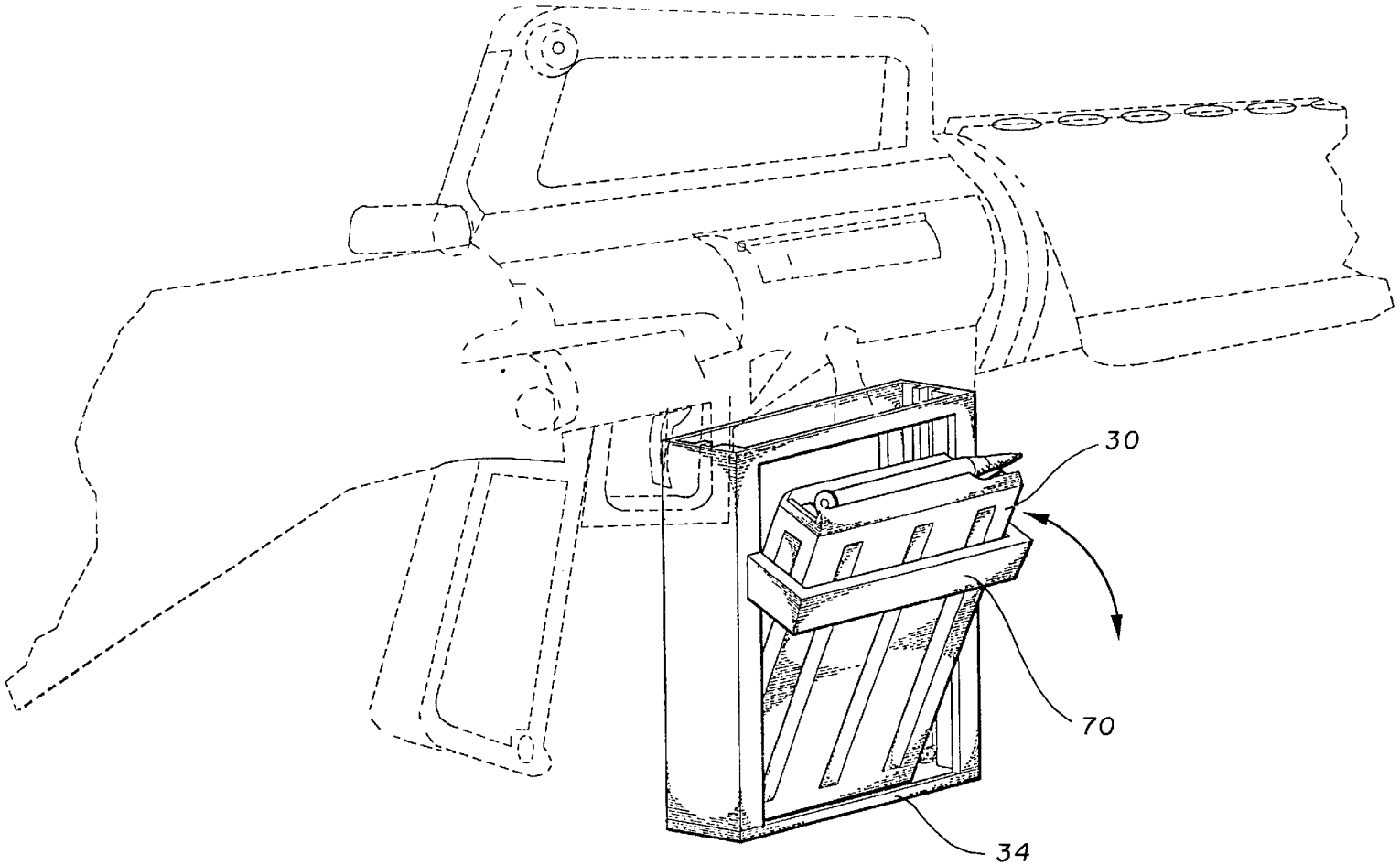
FIG. 2 is a partial environmental, perspective view of a second embodiment in accordance with the present invention, showing an accessory for permanently connection to the firearm wherein the magazine is tilted out from a shroud for loading of cartridges.
Figure 3:
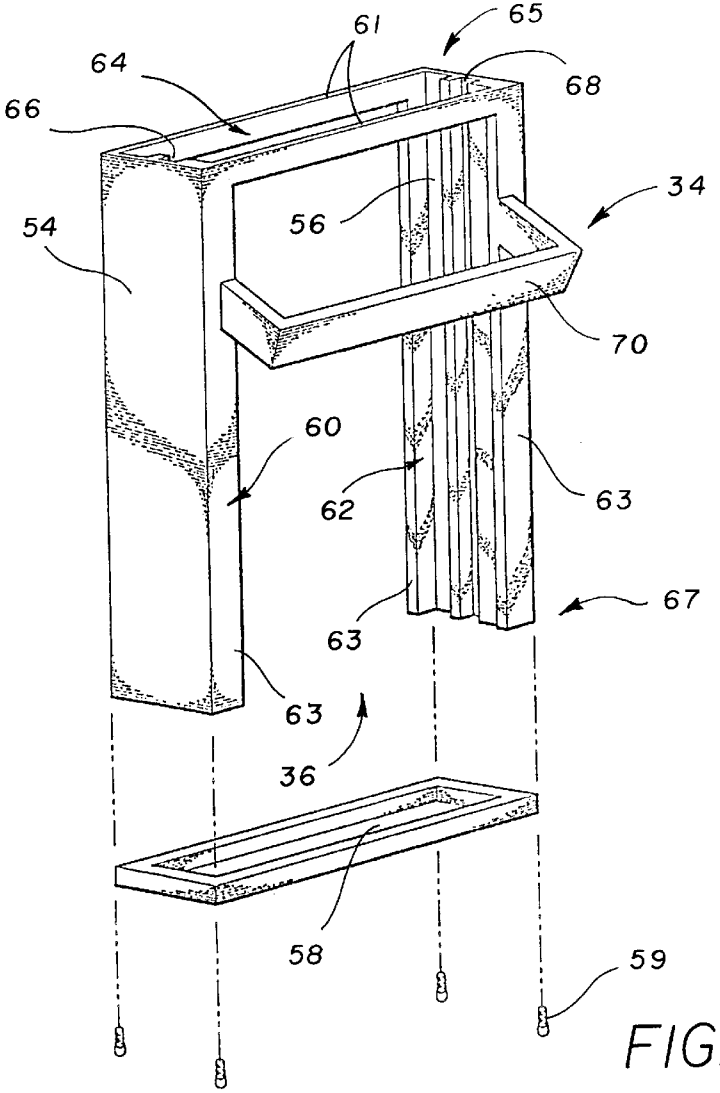
FIG. 3 is a perspective, exploded view of the shroud as shown in FIG. 2.

Referring now to FIG. 2 and FIG. 3, the accessory includes a shroud 34, having a top end 65 and a bottom end 67, which encloses the box magazine 30 and which is affixed at the top end 65 to the lower receiver 14 of the firearm 10. The shroud 34 bands the magazine 30 along its side and bottom walls and is internally provided with a track 68 for receiving the pivot stud 48 depending from each side walls 38. This configuration allows the magazine 30 to be translated between a first position engaged with the lower receiver 14 and a second position disengaged from the lower receiver 14 with the magazine 30 resting on the bottom end 67 of the shroud 34, as shown by FIG. 2.

Specifically, the shroud 34 has a first end wall 54, a second end wall 56 spaced laterally and parallel to the first end wall 54, a first frame member 60 and a second frame member 62 each integrally connected to the end walls 54,56 to maintain the lateral spacing of the end walls 54,56, and a detachable bottom plate 58. In the preferred embodiment, the first frame member 60 and the second frame member 62 are each generally U-shaped, thereby each defining 1) a cross member 61 which, in combination with the firearm, depends from the lower receiver 14, and 2) integral flanges 63 each extending from a first and second end wall 54, 56 and terminally attached to the cross member 61. Each of the side frame members 60,62 thus define the window-type opening 36 between the flanges and cross member.

The second end wall 56 is laterally spaced from and opposed to the first end wall 54 so as to form a structural arrangement having an interior space (not numbered) for receiving the magazine 30. An elongated opening 64 is defined between both the cross members 61,61 and end walls 54,56, the opening 64 allowing close passage of magazine 30 in order to permit engagement and disengagement of the lower receiver 14 by the magazine 30. When the end walls 54,56 and frame members 60,64 are permanently affixed to the lower receiver 14, such as by spot welds, screws, or integral formation with the lower receiver, the end walls 54,56 depend downwardly to form a pair of free ends at the bottom end 67, and defining the magazine space therebetween.

Each end wall 54,56 has a guide groove or track 66,68, respectively, facing one another into the magazine space, and extending longitudinally between the top end 64 and the bottom end 67. Each track receives a pivot stud 48 and permits the stud 48 to slide in a reciprocal manner in the guide groove 66,68.

Once the magazine 30 has been inserted, the bottom plate 58 spans magazine space from end wall 54 to end wall 56, and thereby secures the magazine 30 from removal from the shroud 34. The bottom plate 58 may be spot welded to the end walls, or in the alternative, other fastening means may be provided. A plurality of screws 59 are shown in FIG. 3, which pass through apertures (not shown) in the bottom plate 58 and into mating holes (not shown) in the end walls positioned in registry with the apertures of the bottom plate 58.

As is apparent from the Figures, the pivot studs 48 each act as a means for pivoting the magazine 30 when it is its open angular position with respect to the shroud 34. Each of the pivot studs 48 is, respectively, in its lowest position in the guide grooves, 66,68 when the magazine 30 is in its angular unloading and loading position as shown in FIG. 2.

The above described arrangement allows the magazine 30, when slidably engaged within the tracks 66,68 to be moved from a first position, inserted into the lower receiver 14 and partially contained within an upper portion of the magazine space, to a second position, wherein the magazine is disengaged and entirely free of the lower receiver 14. Without further restraint, the magazine can be pivoted to an angular position to either side of the shroud 34 wherein most the magazine lies substantially outside the confines of the shroud.

However, as shown in FIG. 2, a restraint to limit the angular motion of the magazine 30 is provided. A U-shaped retaining band 70 constitutes a bridge between the end walls 54,56, having a first end and second end affixed respectively to a flange 63 of the first and second frame members 60,62 proximate the top end 65 of the shroud 34. In the second position, the magazine 30 can be rested at a predetermined angle on the band 70, and may then be slid by means of the pivot studs 48 and tracks 66,68 upwardly through the respective window-like opening 36 above the band 70. Thereby, the magazine 30 is partially extended outside the upper portion of the magazine space to gain access for selectively loading and unloading the magazine well with cartridges.

From the foregoing it should be apparent that the magazine 30 is pivotally mounted within the shroud 34 and a permanent connection exists between the semi-automatic firearm 10 and its magazine 30. Specifically, in the instant invention, an AR-15 firearm has been modified by the accessory for forming a permanent-type connection between the firearm and its magazine. It is to be appreciated that the magazine 30 may be sized for any particular caliber or shell or cartridge. Accordingly, the optimum dimensional relationships for the various components of the invention, to include variations in size, materials, shape form, function and manner of operation, assembly and use, are deemed readily apparent and obvious to those skilled in the art, and therefore, all relationships equivalent to those illustrated in the drawings and described in the specification are intended to be encompassed only by the scope of appended claims.

It is to be understood that the invention is not limited in any manner to the embodiment described above, but includes any and all embodiments encompassed by the following claims.

I claim:

1. An accessory for use with a firearm having a receiver and a detachable box magazine, comprising:

a box magazine for receiving at least one firearm cartridge, said box magazine having a first top end for detachably engaging a receiver including a mouth for dispensing cartridges, a first side wall, a second side wall laterally spaced from and opposing said first side wall, and a pivot stud outwardly depending from each of said first side wall and said second side wall; and a shroud for partially enclosing said box magazine, said shroud including a second top end dimensioned and configured to be joined to the receiver and a bottom end, a first end wall coplanar with said first side wall and defining a track pivotally and slidably receiving one said pivot stud, said track extending substantially from proximate said bottom end to proximate said second top end, a second end wall coplanar with said second side wall defining a track pivotally and slidably receiving a different one said pivot stud, said track extending substantially from proximate said bottom end to proximate said second top end, said second end wall laterally opposing and spaced from said first end wall thereby defining a magazine space for closely receiving said box magazine, an elongated opening at said second top end being in general registry with said mouth of said magazine, a window permitting lateral passage of said box magazine between said first and second end walls, and an open bottom end permitting insertion of said magazine, and wherein further said tracks of said coplanar end walls are engaged to said pivot studs to allow the magazine to translate between a first position wherein said top end is operably engaged with the receiver to a second position wherein said top end of said magazine is disengaged and free of the receiver and permitted to pass through said window, and a first frame member and a second frame member laterally opposing said first frame member, said first and second frame members each rigidly spanning from said first end wall to said second end wall thereby maintaining the spatial relationship of said first end wall and said second end wall whereby said magazine can be translated between a first position wherein said top end is operably engaged with the receiver to a second position wherein said top end of said magazine is disengaged and free of the receiver, and wherein further said magazine is free to pivot about said pivot stud and permit angular passage relative to said shroud through said window.

2. The accessory according to claim 1, further comprising a limiting means for limiting the angular passage of said magazine through said window to a predetermined angle relative to said shroud.

3. The accessory according to claim 2, wherein said limiting means includes a bridge member spanning said first end wall and said second end wall of said shroud and offset therefrom.

4. The accessory according to claim 1, wherein each said track is defined to extend to and open at said bottom end to permit insertion of said pivot studs, and further including a bottom plate attached to and spanning said open bottom end from said first end wall to second end wall, thereby enclosing said magazine within said magazine space.

5. The accessory according to claim 4, wherein said bottom plate is removable from said open bottom end and further including fastening means for removably fastening said bottom plate to said bottom end.

6. The accessory according to claim 5, wherein said fastening means includes a plurality of screws passing through said bottom plate into said end walls.

7. The accessory according to claim 1, wherein said pivot studs are each removable from said side walls, each of said first and second side walls defining an aperture, and includes a pin member removably inserted into said aperture.

8. An accessory in combination with a firearm having a receiver and a detachable box magazine, the accessory comprising:

a box magazine for receiving at least one firearm cartridge, said box magazine having a first top end for detachably engaging a receiver including a mouth for dispensing cartridges, a first side wall, a second side wall laterally spaced from and opposing said first side wall, and a pivot stud outwardly depending from each of said first side wall and said second side wall; and a shroud for partially enclosing said box magazine, said shroud including a second top end integrally joined to said receiver and a bottom end, a first end wall depending from said receiver and coplanar with said first side wall, said first end wall defining a track pivotally and slidably receiving one said pivot stud, said track extending substantially from proximate said bottom end to proximate said second top end, a second end wall depending from said receiver and coplanar with said second side wall, said second end wall defining a track pivotally and slidably receiving a different one said pivot stud, said track extending substantially from proximate said bottom end to proximate said second top end, wherein said second end wall laterally opposes and is spaced from said first end wall, thereby defining a magazine space for closely receiving said box magazine, an elongated opening at said second top end being in general registry with said mouth of said magazine, a window permitting lateral passage of said box magazine between said first and second end walls, and an open bottom end permitting insertion of said magazine, wherein further said tracks of said coplanar end walls are engaged to said pivot studs to allow said magazine to translate between a first position wherein said top end is operably engaged with said receiver to a second position wherein said top end of said magazine is disengaged and free of said receiver and permitted to pass in part through said window, and a first frame member and a second frame member laterally opposing said first frame member, said first and second frame members each rigidly spanning from said first end wall to said second end wall thereby maintaining the spatial relationship of said first end wall and said second end wall;

whereby said magazine can be translated between a first position wherein said top end is operably engaged with said receiver to a second position wherein said top end of said magazine is disengaged and free of said receiver, and wherein further said magazine is free to pivot about said pivot stud and permit angular passage relative to said shroud through said window.

9. The accessory according to claim 8, further comprising a limiting means for limiting the angular passage of said magazine through said window to a predetermined angle relative to said shroud.

10. The accessory according to claim 9, wherein said limiting means includes a bridge member spanning said first end wall and said second end wall of said shroud and offset therefrom.

11. The accessory according to claim 8, wherein each said track is defined to extend to and open at said bottom end to permit insertion of said pivot studs, and further including a bottom plate attached to and spanning said open bottom end from said first end wall to second end wall, thereby enclosing said magazine within said magazine space.

12. The accessory according to claim 11, wherein said bottom plate is removable from said open bottom end and further including fastening means for removably fastening said bottom plate to said bottom end.

13. The accessory according to claim 12, wherein said fastening means includes a plurality of screws passing through said bottom plate into said end walls.

14. The accessory according to claim 8, wherein said pivot studs are each removable from said side walls, each of said first and second side walls defining an aperture, and includes a pin removably inserted into said aperture.

* * * * *